United States Patent [19]

Ramadorai et al.

[11] Patent Number: 4,731,114

[45] Date of Patent: Mar. 15, 1988

[54] RECOVERY OF PRECIOUS METALS FROM REFRACTORY LOW-GRADE ORES

[75] Inventors: Gopalan Ramadorai, Golden; Mahesh C. Jha, Arvada, both of Colo.; Marcy J. Kramer, Rye, N.Y.

[73] Assignee: Amax Inc., Greenwich, Conn.

[21] Appl. No.: 7,581

[22] Filed: Jan. 28, 1987

Related U.S. Application Data

[63] Continuation-in-part of Ser. No. 701,258, Feb. 13, 1985, abandoned.

[51] Int. Cl.[4] ..... C22B 11/00

[52] U.S. Cl. ..... 75/118 R; 75/2; 75/7; 75/9; 75/101 R; 75/105; 75/115; 423/29; 423/30; 423/31; 423/41; 423/45; 423/47

[58] Field of Search ..... 75/101 R, 2, 7, 105, 75/9, 106, 107, 115, 118 R; 423/27, 29, 30, 31, 41, 45, 47

[56] References Cited

U.S. PATENT DOCUMENTS

| | | | |
|---|---|---|---|
| 1,257,612 | 2/1918 | Kirchen et al. | 423/29 |
| 1,562,942 | 11/1925 | Coolbaugh et al. | 423/29 |
| 2,759,809 | 8/1956 | Aimone et al. | 75/105 |
| 4,293,530 | 10/1981 | Livesey-Goldblatt | 423/29 |
| 4,431,614 | 2/1984 | Makipirtti et al. | 75/105 |
| 4,497,778 | 2/1985 | Pooley | 75/118 R |

FOREIGN PATENT DOCUMENTS

| | | | |
|---|---|---|---|
| 0081221 | 4/1986 | European Pat. Off. | 423/30 |
| 2845717 | 4/1979 | Fed. Rep. of Germany | 423/29 |

*Primary Examiner*—Robert L. Stoll

*Attorney, Agent, or Firm*—Michael A. Ciomek; Eugene J. Kalil

[57] ABSTRACT

Low-grade refractory gold ores, which may also contain silver and other metal values are treated by partial roasting of concentrate to remove controlled amounts of sulfur and carbon, then oxygen pressure leached to oxidize further amounts of sulfur and carbon and to dissolve base metals and a portion of any silver present, and the residue is then cyanided to dissolve gold and remaining silver which are then recovered.

8 Claims, 1 Drawing Figure

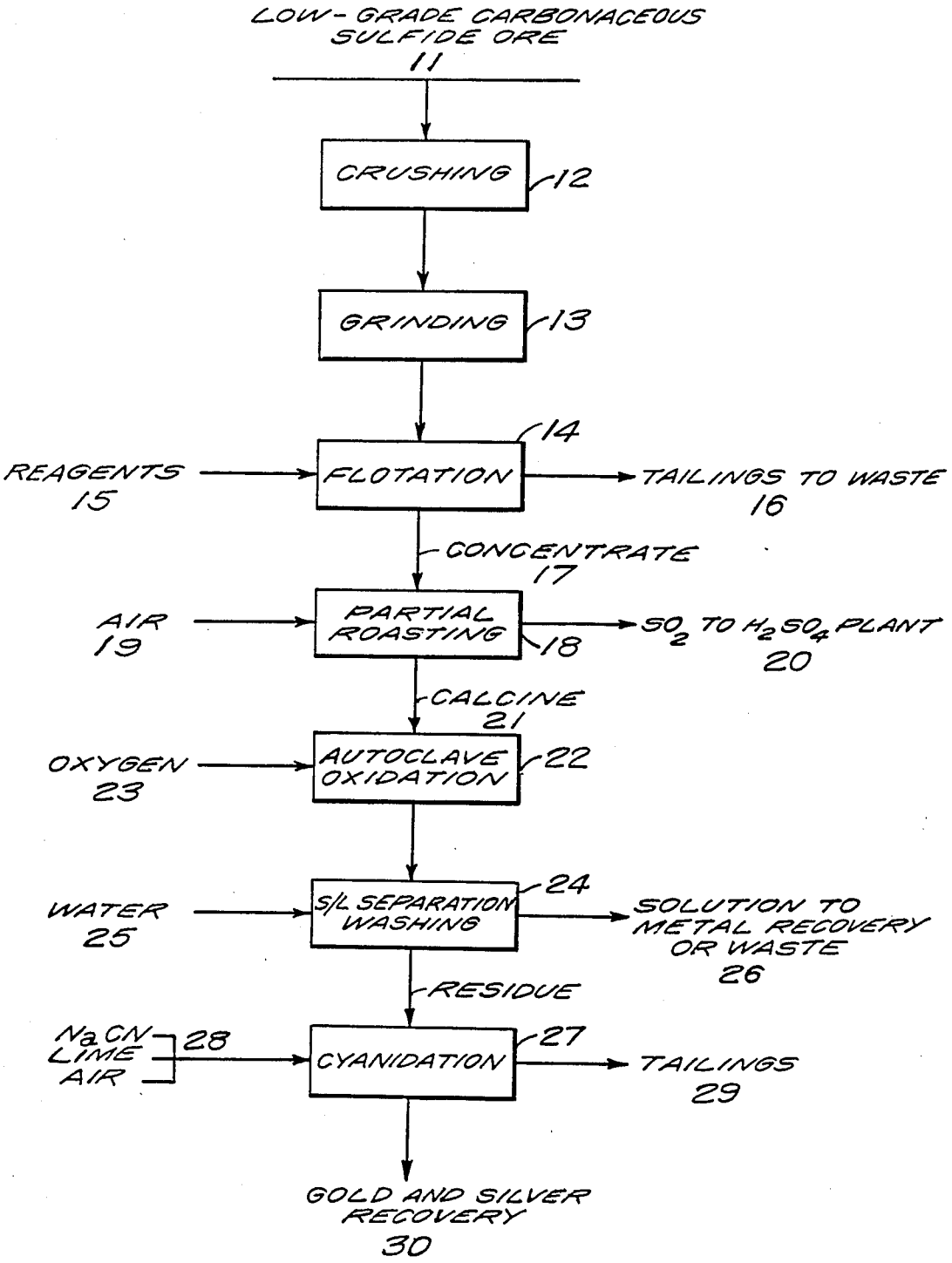
LOW-GRADE CARBONACEOUS SULFIDE ORE
11
CRUSHING
12
GRINDING
13
14
REAGENTS
15
FLOTATION
TAILINGS TO WASTE
16
CONCENTRATE
17
AIR
19
PARTIAL ROASTING
18
$SO_2$ TO $H_2SO_4$ PLANT
20
CALCINE
21
OXYGEN
23
AUTOCLAVE OXIDATION
22
WATER
25
S/L SEPARATION WASHING
24
SOLUTION TO METAL RECOVERY OR WASTE
26
RESIDUE
NaCN
LIME
AIR
28
CYANIDATION
27
TAILINGS
29
GOLD AND SILVER RECOVERY
30

RECOVERY OF PRECIOUS METALS FROM REFRACTORY LOW-GRADE ORES

This application is continuation-in-part of our copending application Ser. No. 701,258 filed Feb. 13, 1985, now abandoned.

This invention relates to the recovery of gold and silver from low-grade refractory ores in which the presence of base metal sulfides, as well as the organic carbon, renders the conventional cyanidation process ineffective.

BACKGROUND OF THE INVENTION AND THE PRIOR ART

Most of the primary gold and silver produced today is recovered by a process which involves cyanidation of the ore to dissolve precious metal values, followed by recovery of dissolved values from solution using zinc-dust cementation or activated carbon adsorption processes. Cyanidation is a simple and relatively inexpensive process that works very effectively on free milling ores. In these ores, gold and silver are present in free form in a matrix of oxide gangue.

However, in many other ores, gold and silver are finely disseminated in sulfide minerals such as pyrite, pyrrhotite, arsenopyrite, sphalerite, etc., which adversely affect the efficiency of the cyanidation process. The effect is both physical and chemical in nature. Physically, cyanide ions cannot reach gold particles entrapped inside dense sulfide particles. Chemically, sulfide minerals consume oxygen and cyanide, thereby retarding gold dissolution.

There are also some oxide ores in which organic carbon is present which adversely affects the extraction of gold. In this case, although the gold is dissolved by cyanide solution, it is prematurely removed from the solution by adsorption on the organic carbon.

Such ores, which due to the presence of sulfide minerals or organic carbon or the like are not amenable to conventional cyanidation treatment, are called refractory ores. As the known reserves of free milling gold ores are being depleted, attention is being focused on developing efficient processes to recover gold and silver from refractory ores, many of which are low-grade as well. The present invention is aimed at providing such a process.

Processes have been developed in the past to treat sulfide ores or ores containing organic carbon. These processes, briefly described below, generally involve an oxidation pretreatment step prior to cyanidation. When any such process is applied to a low-grade ore i.e., an ore containing only up to about 3 to 5 ppm gold and/or up to about 25 to 50 ppm silver, containing both sulfides and carbon, the dissolution of gold and silver in cyanide solution is still relatively low. The present process significantly enhances the recovery of gold and silver from low-grade carbonaceous sulfide ores.

There are several reasons for poor gold and silver extractions during the cyanidation of the sulfide ores:

1. The gold and silver values may be trapped inside the sulfide mineral grains either in solid solution or at extremely fine dissemination. Thus cyanide solution cannot reach them even at very fine grinding.

2. The sulfide minerals react in the system consuming valuable reagents, as well as depriving the solution of available oxygen, leading to slow gold dissolution rates.

3. The presence of sulfide minerals also causes electrochemical passivation of the gold, thus stopping the leach process altogether.

In order to overcome these problems, the sulfide minerals have to be oxidized to liberate the precious metal values and render them amenable to cyanidation.

Roasting of the sulfide ore or a sulfide concentrate is a common practice to accomplish this oxidation. Commercial operations that roast refractory sulfide ores or concentrates and then cyanide the calcine (roaster product) to recover the gold are known in the art. Reference can be made, for example, to publications such as F. W. McQuiston, Jr. and R. S. Shoemaker, *Gold and Silver Cyanidation Plant Practice, Monograph,* The American Institute of Mining, Metallurgical and Petroleum Engineers, Inc., New York 1975; and M. C. Jha and M. J. Kramer, "Recovery of Gold from Arsenical Ores", in *Precious Metals: Mining, Extraction, and Processing,* V. Kudryk, et al. (editors), The Metallurgical Society of AIME, Warrendale, Pa., 1984, pp 337–365. While single- and multiple-hearth roasters were commonly used before the 1950's, fluidized-bed roasters are almost universally used now. Depending upon the sulfur and/or arsenic contents of the feed, which in most cases is a flotation concentrate, different roasting temperatures in the range of 450° to 700° C. have been used by different plants. Some plants, particularly those treating high arsenic feed, use a two-stage roasting practice. Less than stoichiometric quantities of air (required to oxidize all of the sulfur and arsenic to their oxides) is used in the first stage, where most of the arsenic and about half of the sulfur are oxidized to volatile $As_2O_3$ and $SO_2$ gas, respectively. The remaining sulfur is burned in the second stage with an excess of air.

A major technical problem associated with roasting is the sintering of particles, entrapping gold and silver, which diminishes the recovery of these precious metals in the subsequent cyanidation step. This problem is more severe when some other base metal sulfides are also present along with the pyrite. The oxides of these metals combine with the iron oxide to form ferrite compounds, which have lower melting points. The gold and silver entrapped in these ferrite sinters are not amenable to cyanidation.

As an alternative oxidation process to avoid problems associated with sintering of particles during roasting, autoclave oxidation of sulfide concentrates was recommended in U.S. Pat. No. 2,777,764. Several examples cited in this patent demonstrated that autoclave oxidation, followed by cyanidation, resulted in higher gold extractions than cyanidation of sulfide concentrates or roasted calcines. A major shortcoming of this autoclaving process is that expensive oxygen is used rather than the air which is used in roasting. Moreover, the amount of oxygen required is considerably more than in the roasting because sulfur is oxidized to sulfate form rather than to sulfur oxide. Furthermore, the sulfate solution has to be neutralized prior to its disposal. Thus, the autoclave oxidation process, while attractive from the gold recovery point of view, has not been pursued because of the expensive oxygen requirement. This expense is directly related to the sulfur content of the feed, and the process will be least attractive for sulfide materials containing high amounts of sulfur, and low gold and silver values.

Turning to the treatment of carbonaceous ores, aqueous oxidation has been suggested as a pretreatment. Thus, U.S. Pat. No. 3,574,600 describes the use of either an air-ozone mixture or an alkaline sodium or calcium hypochlorite solution to treat the ore prior to cyanidation. A two-stage oxidation process, using air or oxygen in the first stage and chlorine in the second stage, is described in U.S. Pat. No. 4,259,107. The incentive for using air or oxygen in the first stage was to decrease the chlorine requirements. It is worth noting that the ore sample used in the first case contained no sulfur, only 0.35 percent organic carbon and about 7 ppm gold. The ore sample used in the second case contained a small amount of sulfur (about 0.5 percent), a little higher (0.7 percent) organic carbon, and considerably higher (14 ppm) gold. Chlorination is also suggested as a pretreatment step in U.S. Pat. No. 4,289,532.

It is obvious that none of these processes can be applied to low-grade carbonaceous sulfide ores that may typically contain only about 3 to 4 ppm (i.e., about 0.09 to about 0.13 oz./ton) gold and 20 to 30 ppm silver with 0.5 to 1 percent organic carbon and 5 to 10 percent sulfur. The concentrates produced from such ores may contain about 10 to 15 ppm gold and 70 to 100 ppm silver with 1 to 3 percent organic carbon and 20 to 30 percent sulfur. Aqueous oxidation treatment of such ores or concentrates will involve an excessive requirement of oxygen and/or chlorine.

Thus, one is left with no choice but to adopt a roasting pretreatment prior to cyanidation. As explained before and illustrated by examples later, the recovery of gold following this roasting and cyanidation process is limited to about the 70 to 80 percent range due to the formation of ferrites during roasting. Silver recoveries can vary from a few percent to about 30 percent.

We have now developed a process in which a combination of roasting and autoclave oxidation is used prior to cyanidation, resulting in 90 to 95 percent or even higher dissolution of gold in the cyanidation step. Silver dissolution is also significantly improved.

OBJECTIVES OF THE INVENTION

The prime objective of the invention is to provide a process for enhanced recovery of gold and silver from carbonaceous sulfide ores, particularly ores of low grade. Another objective is to provide pretreatment processes to oxidize sulfur and carbon present in the ore in such a way that gold and silver values are not entrapped in refractory ferrite compounds and are thus amenable to cyanidation. Still another objective is to accomplish the oxidation process without consuming excessive amounts of expensive oxygen in the autoclave oxidation step, while solubilizing some silver and essentially all of the base metal values in the autoclave liquor from which it can be recovered.

DESCRIPTION OF THE DRAWING

The drawing consists of a flowsheet setting forth the preferred method for carrying out the invention.

BRIEF DESCRIPTION OF THE INVENTION

In accordance with the invention the refractory gold- and/or silver-bearing sulfide ore, which usually also is carbonaceous, is crushed, ground and concentrated. Flotation or gravity separation methods can be used. The concentrate is then partially roasted to oxidize a major (i.e., more than 50%) proportion of the sulfur but only a minor (i.e., less than 50%) proportion of the carbon in the concentrate. The calcine is then autoclaved in the presence of oxygen to oxidize the remaining sulfide sulfur and organic carbon, to decompose any ferrites in the calcine and dissolve base metals and some silver, which can be recovered from the leach liquor. The autoclave residue, after washing, is subjected to the standard cyanidation process. Gold dissolution is found to be 90% to 95% or higher while most of the silver present in the feed is also dissolved. The dissolved gold and silver values can be recovered from the cyanide solution using standard practices such as zinc-dust cementation or activated carbon adsorption.

Desirably, the roasting temperatures are in the range of about 600° to 650° C. During roasting, less than stoichiometric (theoretical amount needed to oxidize all the sulfur and carbon present in the feed) quantities of oxygen, as air, is used. This is done by controlling the air flow rate in relation to sulfide feed rate to the roaster. About 65 to 80 percent of the sulfur present in the feed is removed as $SO_2$ gas. The carbon oxidation is limited to about 15 to 30 percent.

Fluid bed roasters, rotary kilns, etc., can be employed in the roasting step. Sulfur dioxide generated during roasting can be converted to sulfuric acid or can be scrubbed with alkali and disposed of suitably.

DETAILED DESCRIPTION OF THE INVENTION

The invention will now be described in conjunction with the drawing in which reference character 11 indicates low-grade carbonaceous sulfide ore which is fed to the process for crushing 12, grinding 13, flotation 14 to which reagents 15 are fed and from which tailings 16 are rejected, as is or after cyanidation to recover any gold or silver values present in them. Concentrate 17 is fed to the partial roasting operation 18 to which air 19 is fed and from which $SO_2$ 20 is led to the sulfuric acid plant (not shown) and calcine 21 is delivered to autoclave oxidation step 22 to which oxygen 23 is supplied. The autoclave product is led to solid-liquid separation and washing step 24 which is supplied with water 25. The solution resulting is taken to recovery step 26 while the residue is fed to cyanidation 27 which is supplied with reagents 28 and from which rejected tailings 29 flow. The solution is taken to recovery step 30.

While the process of this invention can be applied to any gold- or silver-bearing sulfide ore, it is particularly attractive for treating low-grade carbonaceous sulfide ores of gold found in several parts of the world. Typical analysis of this type of ore is presented in Table 1, below.

TABLE 1

Typical Analysis of Low-Grade Carbonaceous Sulfide Ore Used in Test Work

| Element | Analysis |
|---|---|
| Gold | 3 ppm |
| Silver | 20 ppm |
| Iron | 6 percent |
| Zinc | 1 percent |
| Sulfur | 7 percent |
| Organic Carbon | 0.7 percent |

When samples of this ore were subjected to the standard cyanidation test, only about 25 percent of the gold and about 10 percent of the silver could be dissolved, as shown by Example 1. This refractory nature of the ore is not surprising in view of the high sulfur and carbon contents of the ore.

Concentrate Preparation

It is necessary to oxidize the sulfur and carbon contents in order to enhance the recovery of gold and silver during subsequent cyanidation. In order to keep the size of the oxidation and cyanidation plants small, it is prudent, although not necessary, to physically beneficiate such low-grade ores and recover most of the precious metal values in an upgraded sulfide concentrate. The increased sulfur and carbon contents also help in making the oxidation process autogenous in terms of energy requirements.

When samples of this particular ore were crushed, ground, and floated with standard sulfide flotation reagents, about 85 percent of the contained gold and silver values were recovered in a sulfide concentrate weighing about 25 to 30 percent of the original feed. Table 2 lists the typical range of composition for such concentrates.

TABLE 2

Sulfide Concentrates Produced by Flotation

| Element | Analysis Range |
|---|---|
| Gold | 9 to 11 ppm |
| Silver | 50 to 80 ppm |
| Iron | 19 to 25 percent |
| Zinc | 1.1 to 2.8 percent |
| Sulfur | 22 to 29 percent |
| Organic Carbon | 2 to 3 percent |

Cyanidation of such flotation concentrates, as shown by Example 2, resulted in only about 30 percent dissolution of gold and silver. Conventional oxidation pretreatment processes using oxidants such as chlorine, air, oxygen, etc., improved the extractions only marginally. Increasing the fineness of the grind did not improve the extractions. "Preg-robbing" of gold (premature precipitation on carbon) in particular and that of silver to a lesser degree, was observed. Reducing the cyanidation time to minimize "preg-robbing" improved the extractions by 10 percent or less. This indicates that most of the precious metals are present in the grains of sulfide minerals and are, therefore, not amenable to cyanidation.

Roasting

To oxidize the sulfur and carbon present in the concentrates, and thereby make them amenable to cyanidation, flotation concentrates were roasted in a 15-inch fluidized-bed furnace at temperatures in the range of 600° to 700° C. The typical composition range of the resulting calcines is presented in Table 3. There is some upgrading of gold and silver contents due to weight loss associated with oxidation of sulfur and carbon.

TABLE 3

Typical Composition Range of Calcines Produced by Fluidized-Bed Roasting of Sulfide Concentrates

| Element | Analysis |
|---|---|
| Gold | 11 to 14 ppm |
| Silver | 100 to 150 ppm |
| Iron | 24 to 26 percent |
| Zinc | 3 to 4 percent |
| Total Sulfur | 1.5 to 2.3 percent |
| Organic Carbon | 0.2 to 1.4 percent |

When calcine samples I and II were subjected to standard cyanidation tests, the gold extractions were 62 and 69 percent, respectively, as shown by Example 3. Treating the calcine samples with hot sulfuric acid, followed by washing them with hot water prior to cyanidation, improved the gold dissolution further to 70 percent and 85 percent, respectively, as shown by Example 4. The silver extractions were 38 and 50 percent, respectively, from the first sample (untreated and treated) and only 27 percent from the second sample, regardless of the treatment. The second sample, containing lower sulfur and carbon contents, represents more complete roasting. Poor silver extraction from this sample would suggest fixation of silver in ferrites, thereby impeding its dissolution in cyanide solution.

It should be mentioned here that while gold and silver are both precious metals and it is desirable to improve recovery of both metals, gold is considerably more precious than silver. Thus, an improvement of 1 percent in gold extraction may be as important as an improvement of several percent in silver extraction.

The results presented so far (Examples 1 to 4) indicate that careful implementation of the state-of-the-art technology (flotation, roasting, acid treatment, and water washing prior to cyanidation) may result in 70 to 80 percent gold dissolution from these low-grade gold concentrates containing 10 to 14 ppm gold. In view of the recent past and projected future gold prices, it is desirable to improve the gold dissolution to 90 to 95 percent or more, and it is possible to do so by the process of this invention.

Partial Roasting - Autoclaving

One of the reasons for incomplete dissolution of gold and silver from the roasted calcines is the physical and/or chemical inclusion of these metals in the ferrite compounds formed during roasting. Formation of such ferrites is more likely when the concentrate contains base metal sulfides, such as zinc sulfide in the present case. Moreover, selective flotation of a sphalerite (zinc sulfide) concentrate indicated that significant amounts of gold and silver were present in this mineral. Therefore, it is very likely that gold and silver present in this mineral will be converted to inert ferrites during roasting and will not be amenable to cyanidation. The problem becomes even more serious if a higher temperature (e.g. temperatures of about 700° or higher) is used for roasting. Unfortunately, for concentrates containing organic carbon, such high temperatures are unavoidable in order to oxidize sulfur and carbon completely.

However, if only a part of the sulfur and carbon are oxidized in a partial roasting operation, higher temperatures and stronger oxidizing conditions can be avoided. Such an operation would eliminate or minimize inclusion of gold and silver in a refractory ferrite structure. Next, aqueous oxidation in an autoclave could be used not only to oxidize the remaining sulfur and carbon but also to dissolve the zinc and decompose any ferrite present in the partially roasted calcine. It is also likely that hematite formed under autoclave conditions would be more porous than the hematite formed during high temperature roasting, and this should again facilitate the dissolution of gold and silver in a subsequent cyanidation operation.

To illustrate the benefits of combining partial roasting and autoclaving as pretreatment steps prior to cyanidation, several batches of flotation concentrates were partially roasted in fluidized-bed furnaces of 4 to 12-inch diameter at temperatures of 550° to 650° C. with less than stoichiometric amounts of air supplied to the roaster. The composition range of resulting calcines is presented in Table 4. There is a small upgrading of gold and silver contents due to removal of about 70 percent of the sulfur in the partial roasting step. Due to lower temperature and oxygen deficiency used in the roasting step, carbon elimination was under 25 percent.

TABLE 4

| Composition Range of Partially Roasted Calcines | |
|---|---|
| Element | Analysis |
| Gold | 9.7 to 11.3 ppm |
| Silver | 55 to 86 ppm |
| Iron | 1.9 to 27 percent |
| Zinc | 1.2 to 3.1 percent |
| Sulfur | 6.3 to 8.1 percent |
| Carbon | 2.3 to 2.8 percent |

Cyanidation of partially roasted calcines resulted in about 60 percent gold extraction and lower silver extractions as shown by Example 5.

Next, the partially roasted calcines were subjected to aqueous oxidation in an autoclave. The residue from the autoclave was washed with water and then cyanided under standard conditions. Gold extractions of 90 to 95 percent or higher were obtained, depending upon the autoclaving conditions.

It should be remembered that the gold extraction numbers mentioned hereinafter refer to the percent of gold dissolved during the cyanidation step. No dissolution of gold was detected in the autoclaving step. However, for silver, the numbers reported are for overall dissolution, some taking place in the autoclave itself and the rest in the cyanidation step. The silver dissolved in the autoclave, along with zinc or other base metals such as cobalt, nickel, copper, etc., which dissolve completely under autoclave oxidation conditions, can be recovered from the autoclave liquor using standard practices, for example, sulfide precipitation.

Effect of Temperature: Since the success of the process depends upon decomposing the ferrite and transforming it, pyrrhotite, and pyrite to porous hematite, the temperature of the autoclave is an important variable. Higher temperatures improve the kinetics of transformation but make the construction and operation of the autoclave more expensive. Thus, a balance has to be struck. A temperature of 200° to 220° C. gave excellent results, about 95 percent gold extraction, as shown by Example 6. The process can be effectively carried out at lower temperatures, say 150° to 180° C., but a longer retention time would be needed. Similarly, the autoclave can be operated at a higher temperature, 250° or 270° C., to reduce the retention time, but this would involve extra capital and operating costs.

Oxygen Pressure and Pulp Density: The oxygen overpressure is another important variable affecting both the rate of conversion and the cost of the autoclave construction and operation. Again, a higher oxygen pressure would be desirable from the process kinetics point of view, but it would increase the cost of the autoclave and compressor. The effect of oxygen pressure would also be a function of pulp density, which in turn determines the oxygen demand rate. As can be seen from the results presented in Example 7, an oxygen overpressure of 50 psi (measured over and above the steam pressure at the autoclave temperature) was adequate for 10 percent solids in the pulp, but an overpressure of 100 psi was needed at 30 percent solids, which would be about the maximum pulp density in a continuous commercial operation.

Other Variables: There are other autoclave process variables such as intensity of agitation and rate of gas bleeding that will affect the results of the process. However, the effect of these variables is influenced by the geometry of the autoclave and the mode of operation (i.e., batch vs. continuous). Thus, specific ranges for these variables cannot be specified. The basic idea is to provide enough agitation not only to insure off-bottom suspension of all the solid particles but also to provide good mass transfer rate for oxygen from the gas phase to the solids/solution interface where it is consumed to oxidize sulfur and carbon. A certain amount of gas bleeding should be provided to remove the inert carbon dioxide gas from the system. The extent of bleeding primarily depends upon the carbon content of the feed. Excellent results are obtained even when carbon is not oxidized completely. It seems possible that autoclaving may deactivate the organic carbon and thereby counter its bad effect during subsequent cyanidation.

Versatilitv of the Process: To determine and demonstrate the versatility of this novel process, aqueous oxidation treatment in an autoclave was applied to various samples of partially roasted calcines produced from different flotation concentrates under different roasting conditions. The results are presented in Example 8. Autoclaving was performed for 4 hours on pulps containing 10 to 30 percent solids at a temperature of 220° C. and an oxygen overpressure of 100 psi. The residues were washed with water and then cyanided under standard conditions. Gold extraction of over 93 percent was obtained in each case. The silver extraction was variable. High extractions of 70 to 88 percent were observed for silver at the lower pulp density.

To further demonstrate the versatility of the process, samples of ore, concentrate, and totally roasted calcine were subjected to standard autoclaving and cyanidation tests. As the data presented in Example 9 indicate, over 90 percent gold extraction was obtained in each case.

However, due to the large oxygen demand (as detailed in Example 9), direct autoclaving of ore or concentrate may not prove economical. Since all the sulfur present in the ore is oxidized to the sulfate form in the autoclave, not only are the credits for sulfuric acid lost but the neu ralization costs for the autoclave liquor may also be substantial. On the other hand, treatment of totally roasted calcine may not be very attractive, both because of larger roaster capacities needed in this case and poor silver extractions from such calcines even after autoclaving.

The combination of partial roasting of the concentrate, followed by its oxidation in an autoclave, results in 90 percent or higher gold extractions in subsequent cyanidation steps. The gold and silver can be recovered from the cyanide solution by standard processes.

EXAMPLE 1

In this, as well as in the following examples, standard cyanidation tests involved leaching of 60 g dry solid feed with 180 ml of 1.5 g/L NaCN solution in a stirred glass reactor for 24 hours at room temperature. Lime slurry was added to control the pH at 11. Air was sparged to insure a reduction potential (Eh) of at least −100 mv, measured against a standard calomel electrode. Samples of solution were analyzed for free cyanide concentration, and concentrated NaCN solution was added as required to maintain the NaCN strength at about 1.5 g/L throughout cyanidation. The tailings (residue) were washed, dried, weighed, and fire assayed for gold and silver. The feed and tail assays were used to calculate the percent dissolution or extraction of gold and silver.

A sample of low-grade carbonaceous sulfide ore analyzed 3.9 ppm gold, 20 ppm silver, 7.16 percent iron, 1.0 percent zinc, 7.4 percent sulfur, and 0.76 percent organic carbon. The ore sample was subjected to a standard cyanidation test as described above. Only 22 percent of the gold and 9 percent of the silver dissolved. Another cyanidation test was performed after regrinding the feed sample. The gold and silver dissolution improved only to 24 and 15 percent, respectively. The chemical analysis of the cyanide solution samples indicated a decline in gold and silver concentrations from the 6-hour to 24-hour sample. This indicates that the organic carbon was causing "preg-robbing" (i.e., premature precipitation of gold and silver from the pregnant solution).

EXAMPLE 2

A sample of low-grade carbonaceous sulfide ore of composition similar to that shown in Table 1, was subjected to crushing, grinding, and flotation treatment to recover gold and silver in a sulfide concentrate. One of the sulfide concentrate samples analyzed 9.7 ppm gold, 76 ppm silver, 20 percent iron, 2.8 percent zinc, 24 percent sulfur, and 2.5 percent organic carbon. When this sample was subjected to standard cyanidation tests (described in Example 1), only about 30 percent of the gold and 28 percent of the silver were dissolved.

EXAMPLE 3

Two samples of calcine produced by roasting flotation concentrates in a fluidized-bed furnace were subjected to standard cyanidation tests. The chemical composition of the calcines and the extent of dissolution of gold and silver from them during cyanidation are tabulated below. It is seen that roasting pretreatment considerably improved the extraction of gold from the 20 to 30 percent range (Examples 1 and 2) to the 60 to 70 percent range. The extent of silver dissolution remained about the same or improved only slightly.

| | Calcine Sample I | Calcine Sample II |
|---|---|---|
| Composition | | |
| Gold, ppm | 12.0 | 14.2 |
| Silver, ppm | 104 | 146 |
| Iron, percent | 24 | 26 |
| Zinc, percent | 3.3 | 3.8 |
| Sulfide Sulfur, percent | 2.35 | 1.45 |
| Organic Carbon, percent | 1.36 | 0.22 |
| Extraction | | |
| Gold | 63 | 69 |
| Silver | 38 | 27 |

EXAMPLE 4

To remove any soluble salts (like sulfates) from the calcine and activate its surface prior to cyanidation, samples of calcine I and II (described above in Example 3) were treated with dilute sulfuric acid (pH 1) for 1 hour at 90° C. and then washed with hot (90° C.) water. When washed calcines were subjected to standard cyanidation tests, the gold extractions improved to 70 percent for calcine Sample I and to 85 percent for calcine Sample II. The silver extraction from Sample I improved to 50 percent but that from Sample II remained at 27 percent.

EXAMPLE 5

Two samples of partially roasted calcines were subjected to standard cyanidation tests. The composition of these samples and the extraction of gold and silver from them are tabulated below.

| | Partially Roasted Calcine | |
|---|---|---|
| | Sample III | Sample IV |
| Composition | | |
| Gold, ppm | 11.1 | 9.9 |
| Silver, ppm | 55 | 77 |
| Iron, percent | 21 | 27. |
| Zinc, percent | 2.7 | 1.2 |
| Sulfide Sulfur, percent | 7.4 | 6.4 |
| Organic Carbon, percent | 2.3 | 2.8 |
| Extraction, percent | | |
| Gold | 62 | 59 |
| Silver | 22 | 46 |

It is seen that partial roasting considerably improved the gold and silver extractions in comparison to extractions from ore or concentrate (Examples 1 and 2). The higher silver extraction from Sample IV could be due to its higher silver and lower zinc contents in comparison to Sample III.

EXAMPLE 6

A partially roasted calcine Sample V analyzed 11.3 ppm gold, 86 ppm silver, 23 percent iron, 3.1 percent zinc, 6.3 percent sulfide sulfur, and 2.6 percent organic carbon. This sample was used in most of the autoclave oxidation work performed to develop the process of this invention.

Samples of this partially roasted calcine were pulped with dilute, 25 g/L, $H_2SO_4$ to a pulp density of 10 percent solids (100 g solid, 900 ml dilute $H_2SO_4$). The slurry was then heated in a glass lined titanium autoclave while being vigorously agitated. The autoclave was heated by an electrical jacket with a temperature controller that was activated by the actual slurry temperature measured through a thermocouple well in the autoclave. After reaching the desired temperature, reported in the table below, oxygen gas was added to the autoclave to maintain an oxygen overpressure of 50 psi, as measured on a gauge mounted on the autoclave top. The reaction was allowed to proceed for 4 hours. After that time, the oxygen gas line was disconnected, agitation was stopped, and the autoclave removed from the electric jacket and cooled under tap water. Any gas pressure remaining in the autoclave was relieved by bleeding, and the contents of the autoclave were poured on a vacuum filter. The residue was thoroughly washed, dried, weighed, and a sample was analyzed. A 60 g portion of the residue was subjected to the standard cyanidation test as described in Example 1.

A series of four tests was performed with the autoclave temperature set at 150°, 180°, 200°, and 220° C., respectively. Excellent gold and silver extractions (above 95 percent and 85 percent, respectively) were obtained when the temperature was 200° or 220° C., as shown by the data presented in the following table. It should be mentioned here that practically no gold dissolved in the autoclave. However, as the data in the table indicate, a variable amount of silver dissolved in the autoclave. The silver extractions reported in the table were computed for overall dissolution of silver from autoclave feed to cyanidation tailings. The data also indicate that almost all the zinc dissolved in the autoclave step. Other base metals, like copper, cobalt, etc., would have behaved the same way. The data also indicate that at lower temperatures (150° or 180° C.), the sulfur oxidation process was not complete and this aversely affected the extent of gold and silver dissolution.

| Test Number | 1 | 2 | 3 | 4 |
|---|---|---|---|---|
| Autoclave Temperature, °C. | 150 | 180 | 200 | 220 |
| Oxygen Consumption (lb/ton of feed) | — | 191 | 189 | 213 |
| Autoclave Product Analysis | | | | |
| Gold, ppm | 11.1 | 11.7 | 12.0 | 12.0 |
| Silver, ppm | 88 | 82 | 46 | 30 |
| Iron, percent | 20.7 | 24.4 | 24.8 | 24.7 |
| Zinc, percent | 1.6 | 0.02 | 0.02 | 0.03 |
| Sulfur, percent | 3.9 | 1.2 | 0.75 | 0.58 |
| Extraction, percent | | | | |
| Gold | 72 | 88 | 96 | 97 |
| Silver* | 46 | 88 | 88 | 86 |

*Includes extraction in autoclave step.

EXAMPLE 7

In another series of four tests performed at 220° C. the pulp density and oxygen overpressure were varied. The feed and other autoclaving conditions were the same as described in Example 6. As the results presented below indicate, at a low pulp density of 10 percent solids, an oxygen overpressure of 50 psi was adequate. However, at 30 percent solids, a higher oxygen over pressure of 100 psi gave better results.

| Test Number | 1 | 2 | 3 | 4 |
|---|---|---|---|---|
| Pulp Density, % Solids | 10 | 10 | 30 | 30 |
| Oxygen Overpressure, psi | 50 | 100 | 50 | 100 |
| Oxygen Consumption (lb/ton of feed) | 213 | 214 | 387 | 387 |
| Extraction, percent | | | | |
| Gold | 97 | 98 | 86 | 94 |
| Silver* | 86 | 88 | 33 | 52 |

*Includes extraction in autoclave step.

EXAMPLE 8

Samples of partially roasted calcines III, IV, and V (described in Examples 5 and 6) were subjected to autoclave oxidation treatment at the common conditions of 220° C. and 100 psi oxygen overpressure. The pulp density was 10 or 30 percent solids. As shown by the data presented below, excellent gold extractions were obtained in all cases. Silver extractions varied considerably, reflecting probably both variations in feed composition and roasting conditions.

By lowering the pulp density, the silver extraction was greatly improved.

| Test Number<br>Sample Number | 1<br>III | 2<br>III | 3<br>IV | 4<br>V | 5<br>V |
|---|---|---|---|---|---|
| Pulp Density | 30 | 10 | 30 | 30 | 10 |
| Oxygen Consumption (lb/ton of feed) | 334 | — | 307 | 310 | — |
| Extraction, Percent | | | | | |
| Gold | 96 | 99 | 93 | 94 | 98 |
| Silver* | 19 | 76 | 29 | 52 | 88 |

*Includes extraction in autoclave step.

EXAMPLE 9

A series of tests was performed on a variety of feed materials. These materials were ore, flotation concentrate, and partially and fully roasted calcine. These were subject to autoclave oxidation for 4 hours at 220° C. under varying conditions as shown in the following table. Subsequent cyanidation of autoclave residues resulted in over 90 percent gold extraction. The silver extraction was variable, being as high as 92 percent from the concentrate.

| | Test Number | | | | |
|---|---|---|---|---|---|
| | 1 | 2 | 3 | 4 | 5 |
| | Feed Material | | | | |
| | Ore | Concentrate | Partially Roasted Calcine | | Fully Roasted Calcine |
| Composition | | | | | |
| Gold, ppm | 3.9 | 10.7 | 11.1 | 11.1 | 14.0 |
| Silver, ppm | 20 | 54 | 55 | 55 | 146 |
| Iron, percent | 7.6 | 19 | 21 | 21 | 26 |
| Zinc, percent | 1.0 | 2.4 | 2.7 | 2.7 | 3.8 |
| Sulfur, percent | 7.4 | 22 | 7.4 | 7.4 | 1.45 |
| Organic Carbon, percent | 0.76 | 2.4 | 2.3 | 2.3 | 0.22 |
| Autoclave Conditions | | | | | |
| Pulp Density % Solids | 30 | 30 | 10 | 30 | 30 |
| Oxygen Pressure, psi | 100 | 100 | 50 | 100 | 50 |
| Initial $H_2SO_4$, g/L | 25 | 0 | 25 | 0 | 100 |
| Oxygen Consumption (lb/ton of feed) | 418 | 871 | — | 167 | 94 |
| Extraction, Percent | | | | | |
| Gold | 94 | 94 | 99 | 96 | 91 |
| Silver* | 40 | 92 | 76 | 19 | 4 |

*Includes extraction in autoclave step.

Oxygen consumption during autoclaving of the "ore" and "concentrate" materials of Example 9 amounted to 418 pounds per ton of ore and 871 pounds per ton of concentrate. This corresponds to 244 lb/ton of ore since the concentrate weighed 28 percent of the ore. The oxygen consumption during autoclaving of partially roasted calcine was 167 lb/ton of calcine which corresponds to 42 lb/ton of ore since the calcine weight was about 25 percent of the ore. While the oxygen consumption was lowest (94 lb/ton of calcine or about 21 lb/ton of ore), in the case of fully roasted calcine, the silver extraction was negligible. Therefore the partially roasted calcine will be the preferred feed for autoclave treatment. Under suitable conditions as noted in the table above, up to 76 percent of the silver and essentially all of the gold were recovered. The process of the invention thus not only results in high recoveries of gold and silver from low-grade refractory ores but also provides substantial economies in the use of oxygen. Similarly the amount of sulfate ions present in the autoclave liquor either as sulfuric acid or as metal sulfates, are smaller in the case of partially roasted calcines in comparison to the amounts present after treatment of ores or concentrates. A substantial saving in lime slurry required to neutralize the liquors prior to cyanidation is thereby afforded. The saving in oxygen and lime is of particular importance in operation at a remote location.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

What is claimed is:

1. The process for treating a refractory low-grade ore containing precious metals from the group consisting of gold and silver to recover the precious metal content thereof which comprises partially roasting a concentrate of said ore to oxidize a major portion of sulfur present to sulfur dioxide but to oxidize a minor portion only of carbon present therein, subjecting the partially roasted calcine to an oxygen pressure leach to oxidize remaining sulfur and carbon, to decompose any ferrites present and to dissolve base metals and some silver, and then subjecting the residue from said oxygen pressure leach to cyanidation to dissolve substantially all the precious metals present therein.

2. The process in accordance with claim 1 wherein said concentrate is obtained from a low-grade carbonaceous sulfide ore.

3. The process in accordance with claim 2 wherein not more than about 65 to 80% of the sulfur and not more than about 15 to 30% of the carbon is removed during the partial roasting step.

4. The process in accordance with claim 2 wherein said concentrate contains about 1% to about 3%, by weight, of organic carbon and about 20% to about 30%, by weight, of sulfur.

5. The process in accordance with claim 4 wherein said concentrate contains about 8 to about 15 ppm gold and about 50 to about 100 ppm silver.

6. The process in accordance with claim 1 wherein silver dissolved in the oxidation leach liquor is recovered.

7. The process in accordance with claim 1 wherein said partial roasting is conducted at about 550° to about 650° C. in an atmosphere stoichiometrically deficient in oxygen.

8. The process in accordance with claim 7 wherein said partial roasting is conducted at a temperature in the range of about 600° to about 650° C.

* * * * *